US006208304B1

(12) United States Patent
Strickland

(10) Patent No.: US 6,208,304 B1
(45) Date of Patent: Mar. 27, 2001

(54) AIRCRAFT MOUNTED DUAL BLADE ANTENNA ARRAY

(75) Inventor: Peter C. Strickland, Ottawa (CA)

(73) Assignee: EMS Technologies Canada, Ltd., Ottawa (CA)

( * ) Notice: Subject to any disclaimer, the term of this patent is extended or adjusted under 35 U.S.C. 154(b) by 0 days.

(21) Appl. No.: 09/307,703

(22) Filed: May 10, 1999

(51) Int. Cl.[7] ..... H01Q 1/28
(52) U.S. Cl. ..... 343/705; 343/708
(58) Field of Search ..... 343/705, 708; H01Q 1/28

(56) References Cited

U.S. PATENT DOCUMENTS

| | | | | |
|---|---|---|---|---|
| 3,737,906 | | 6/1973 | Maynard | 343/705 |
| 3,836,971 | | 9/1974 | Bickel et al. | 343/100 PE |
| 4,336,543 | | 6/1982 | Ganz et al. | 343/705 |
| 4,405,986 | * | 9/1983 | Gray | 364/434 |
| 4,749,997 | | 6/1988 | Canonico | 343/705 |
| 5,382,959 | * | 1/1995 | Pett et al. | 343/700 MS |
| 5,889,491 | * | 3/1999 | Minter | 342/174 |
| 5,927,648 | * | 7/1999 | Woodland | 244/118.1 |
| 5,945,943 | * | 8/1999 | Kalafus et al. | 342/357 |

* cited by examiner

*Primary Examiner*—Don Wong
*Assistant Examiner*—Shih-Chao Chen
(74) *Attorney, Agent, or Firm*—Pascal & Associates

(57) ABSTRACT

An aircraft mounted antenna system comprising a plurality of linear blade antenna arrays mounted on an upper portion of an aircraft fuselage. The blade arrays are symmetrically placed on the fuselage about a plane vertically bisecting the upper portion of the fuselage. The placement of the blade arrays is such that large scanning angle gain losses are minimized as the blade arrays on one side of the fuselage hand off the satellite tracking, acquisition, and communication to the blade arrays on the other side of the fuselage as the scanning angle increases.

14 Claims, 3 Drawing Sheets

AIRCRAFT MOUNTED DUAL BLADE ANTENNA ARRAY

FIELD OF INVENTION

This invention relates to phased array antennas and specifically to aircraft mounted antenna arrays.

DESCRIPTION OF THE RELATED PRIOR ART:

Antenna arrays mounted on aircraft are a fact of life in today's world. Commercial aircraft are equipped with phased antenna arrays that track orbiting satellites to enable communications. Such communications can be between two aircraft or between an aircraft and ground based stations. The tracking is accomplished by phased array antennas that effectively track the satellite until it is either below the aircraft's horizon or the signal received by the aircraft is too weak to be of any use. The satellite's movement can be in any direction relative to the direction of the aircraft. For effective tracking of such satellites, the phased array antenna must be properly located on the aircraft to maximize the antenna's exposure to the satellite. This means having an antenna system that can track a satellite over the entire upper hemisphere of the aircraft.

A number of approaches have been taken to properly locate and track the orbiting satellite. One possible approach is the use of a rotating radome mounted atop an aircraft. This approach, used by military battle management aircraft, is impractical for commercial aircraft. Not only is it expensive but also quite cumbersome.

Another approach, taken by Ganz et al. and disclosed in U.S. Pat. No. 4,336,543, is to mount the antenna array on the extensions to the aircraft fuselage. Ganz et al. discloses mounting the antenna arrays inside the wings. Also disclosed in the same patent is the idea of mounting antenna arrays on the sides of the fuselage and on the flat portions of the stabilizer. (See FIG. 1) While this concept of installing antenna arrays on or within the airfoil surfaces of the aircraft, such as on the leading edges of the wing and on the horizontal stabilizer trailing edge, is useful, it has a number of drawbacks. As Ganz et al. envision it, the forward looking antenna elements are mounted on the forward section of the wing. This prevents the scanning beam from scanning behind the aircraft. The antenna elements mounted on the horizontal stabilizer trailing edge may solve the backward scanning difficulty yet this configuration can only work with an aircraft having a large stabilizer and not with all aircraft types.

Another related approach is that taken by Canonico in U.S. Pat. No. 4,749,997. In this document, Canonico discloses mounting the antenna arrays within the wing and having a hinged radome to permit easy access for servicing. Unfortunately, this configuration also suffers from the same drawbacks as the Ganz et al. device.

A better approach is taken by Maynard in U.S. Pat. No. 3,737,906. In that document, Maynard discloses mounting a fixed linear array of dipole elements on the upper parts of the aircraft. The scanning advantages of this configuration are readily apparent by examining the possible scanning patterns of such a device. (See FIG. 2) Unfortunately, such a device also has a number of drawbacks. Specifically, these drawbacks relate to a complete loss of gain as the scanning beam moves towards zenith. At zenith, when the satellite is directly over the aircraft, the dipole element has a gain null and the array cannot be used for communications in this direction.

Another approach is the use of conformal rectangular phased arrays. However, such arrays suffer from large scan losses in all planes with the loss being roughly proportional to the cosine of the scan angle. At the horizon, the received signal power is typically far below the detection threshold.

From the above, it can be seen that there is a need for an aircraft mounted antenna system that provides not only a scanning area over the entire upper hemisphere but also a near constant gain over that same scanning area.

SUMMARY OF THE INVENTION

The present invention seeks to overcome the deficiencies identified in the prior art by providing an antenna system which can scan and provide a constant gain over the entire upper hemisphere.

The present invention seeks to provide an antenna system comprising a plurality of linear blade phased array assemblies mounted on an upper half of an aircraft fuselage wherein the longitudinal axis of the fuselage is parallel to the longitudinal axis of each blade array and each array plane containing the longitudinal axis of the fuselage and the longitudinal axis of a blade array is at an angle with a plane vertically bisecting the upper half of the fuselage.

Preferably, there is an equal number of blade arrays on either side of the bisecting plane.

Also preferably, the system includes a blade array located substantially between the upper right quarter of the fuselage and the upper left quarter of the fuselage.

Conveniently, a symmetry angle between an array plane in the upper right quarter of the fuselage and the bisecting plane is substantially equal to an angle defined by an array plane in the upper left quarter of the fuselage and the bisecting plane. Even more conveniently, the symmetry angle is 45 degrees. Also conveniently, the number of blade arrays is two. Preferably, the system further includes a plurality of circularly polarized antenna elements arranged in rows on each blade array. Also preferably, on each blade array the number of elements in each row is at least ten times the number of rows on that blade array.

More preferably, each blade array has 192 antenna elements arranged in three rows of 64 elements per row.

In another embodiment of the invention, there is provided an antenna array system for communicating between an aircraft and an orbiting satellite comprising a plurality of antenna blade arrays longitudinally mounted on an upper portion of an airframe such that there is symmetry between the upper right side of the airframe and the upper left side of the airframe.

In yet another embodiment, there is provided a method of locating blade antenna arrays on an upper portion of an aircraft fuselage, the method comprising:

i) providing a plurality of linear blade phased antenna arrays;

ii) mounting an equal number of blade arrays on each side of the fuselage.

Conveniently, step ii) includes the step of symmetrically mounting the blade arrays on each side of a plane that vertically bisects the fuselage.

More conveniently, the method includes the step of locating a blade array on the fuselage such that the blade array is located on a plane that vertically bisects the upper portion of the fuselage.

In yet another embodiment of the invention, there is provided a method of improving the communication between an aircraft and an overhead satellite comprising: providing a plurality of linear blade phased antenna arrays, and symmetrically mounting an equal number of blade arrays on each side of the aircraft fuselage.

The advantages of the present invention are numerous. Mounting the blade arrays on the upper portion of the fuselage gives a scanning area that covers the whole upper hemisphere. Also, having an equal number of blade arrays on each side of the fuselage provides equal coverage and scanning area for each side of the aircraft. Because the blade arrays are arranged at an angle to the top of the aircraft, the problem of gain decrease due to large scanning angles is eliminated. Also, the balanced character of the blade arrays has the further benefit o balancing the airflow over the top of the aircraft, as opposed to a single blade array configuration.

BRIEF DESCRIPTION OF THE DRAWINGS

A better understanding of the invention will be obtained by considering the detailed description below, with reference to the following drawings in which.

DETAILED DESCRIPTION OF THE INVENTION

Figure 1:
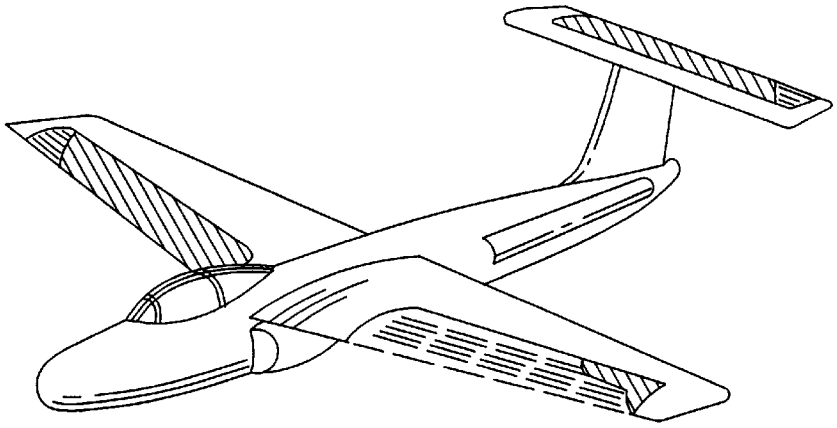
PRIOR ART FIG. 1
FIG. 1 is a perspective view of a first aircraft having antenna arrays located in accordance with the prior art.
Figure 2:
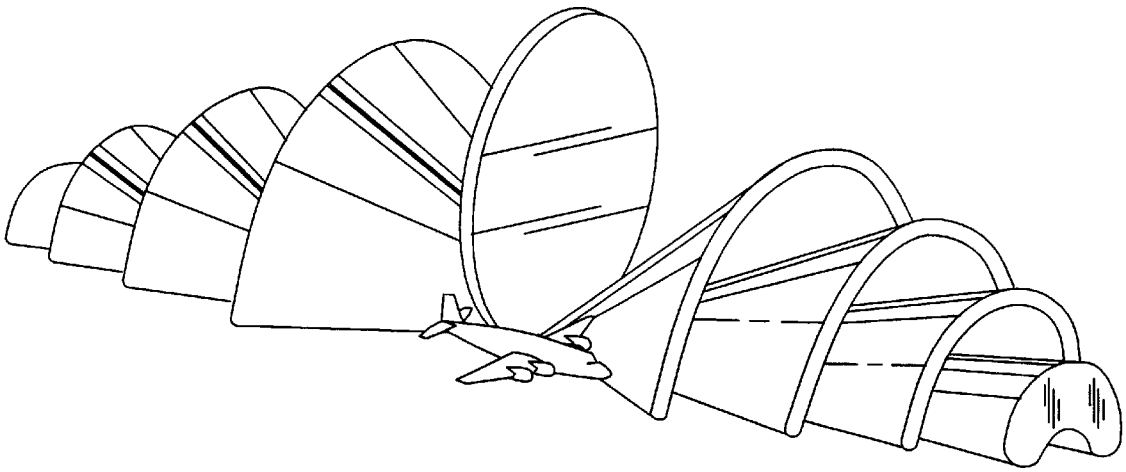
PRIOR ART FIG. 2
FIG. 2 is a perspective view of a second aircraft having antenna arrays located in accordance with other prior art and also showing the scanning areas achievable with this prior art.

Referrring to FIGS. 3 to 6, an antenna system according to the present invention is disclosed. The linear blade phased array antennas 10, 15 are located on the outside of an aircraft fuselage 20. From FIG. 3, it can be seen that the blade arrays 10,15 are at an angle to the the bisecting plane 40. For ease of description, a bisecting plane 40 is defined as the plane that contains the longitudinal axis 30 of the fuselage 20 and that symmetrically bisects the upper half of the fuselage 20.

Figure 3:
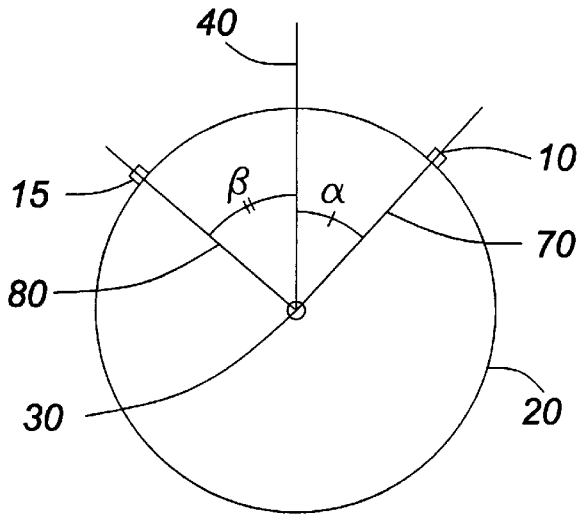
FIG. 3 is a vertical cross-section of an aircraft fuselage detailing the location of blade antenna arrays in accordance with the invention.

As shown in FIG. 3, a ray 70, taken from the longitudinal axis 30 of the fuselage 20 to a right blade array 10 is at an angle $\alpha$ to the bisecting plane 40. Another ray 80, taken from the longitudinal axis 30 of the fuselage 20 to a left blade array 15 is at an angle $\beta$ to the bisecting plane 40.

The angles $\alpha$ and $\beta$ are crucial. Ideally, these angles should be equal to provide for symmetry in the scanning areas of blade arrays 10 and 15. However, these angles need not necessarily be equal.

On the other hand, experimental results have found that locating the blade arrays 10, 15 such that the angles $\alpha$ and $\beta$ are equal and at 45 degrees to the bisecting plane 40 provides the best scanning pattern.

Figure 4:
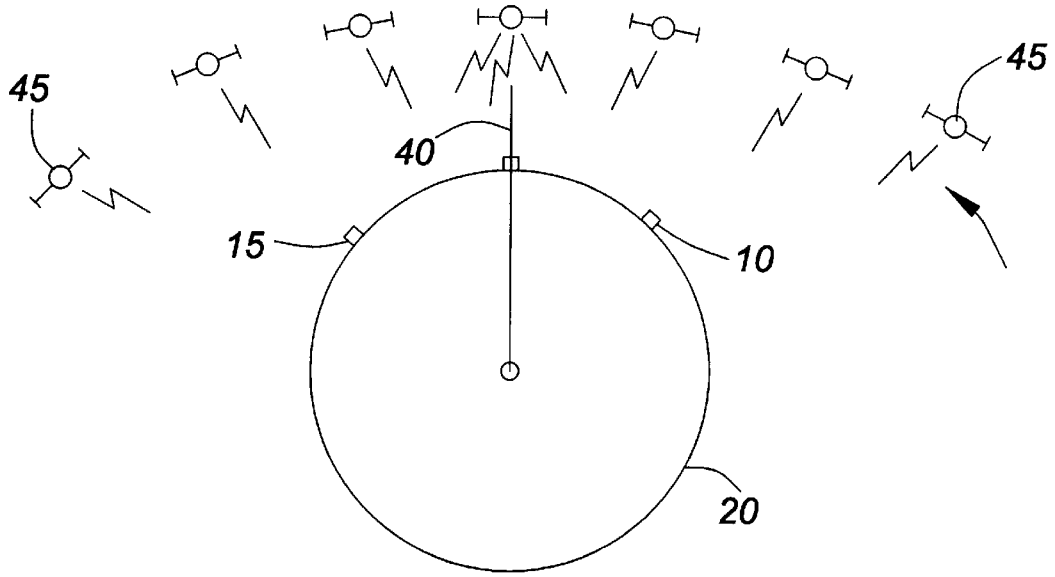
FIG. 4 is a vertical cross-section of an aircraft fuselage detailing the location of blade antenna arrays in accordance with the invention and showing the hand-off procedure to be followed as a satellite traverses the upper hemisphere.

Scanning and tracking a satellite in the upper hemisphere is accomplished by a hand-off procedure between the right blade array 10 and the left blade array 15. This is illustrated in FIG. 4. Assuming a satellite 45 is approaching from the right side of the aircraft, the right blade array 10 acquires and tracks and communicates with the satellite 45. As the satellite 45 traverses the upper hemisphere, the scanning angle of the right blade array 10 increases and consequently, there is a correspondingly slight drop-off in signal gain. As soon as the satellite 45 passes the zenith point, the right blade array 10 can hand off the satellite coverage to the left hand blade array 15. From this point until the satellite 45 drops over the horizon, the left hand blade array 15 tracks and communicates with the satellite 45.

One possible problem is contention between the left hand blade array 15 and the right hand blade array 10 when the satellite 45 is at zenith or very close to zenith. The question of when the hand-off occurs can be problematic. One possible solution can be implemented through the software controlling the antenna arrays. Contention can be solved by having the array with the strongest signal to the satellite 45 do the acquisition and tracking.

Figure 5:
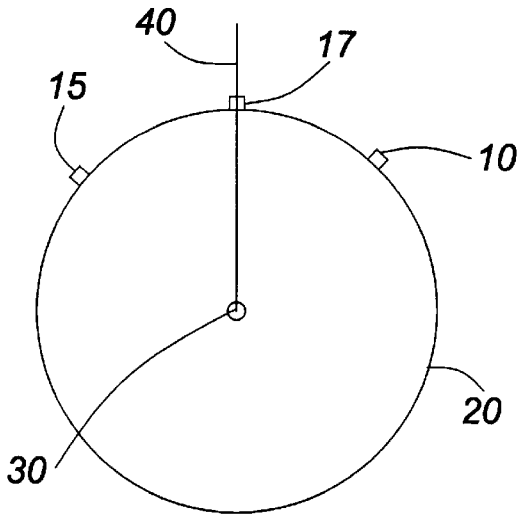
FIG. 5 is a vertical cross-section of an aircraft fuselage detailing the location of blade antenna arrays in accordance with the invention.

Another possible solution to the contention problem is to have a third blade array 17 as shown in FIG. 5. This central blade array 17 would be in the bisecting plane and, ideally, equidistant from the left hand blade array 15 and the right hand blade array 10. Not only would a central blade array 17 solve the problem of contention when the satellite 45 is at zenith but would also assist in having a more constant gain throughout the upper hemisphere. Obviously, the three blade arrays 10, 15, and 17 would have overlapping scanning areas. Again, contention issues can be addressed by having the blade array with the strongest signal do the tracking, acquisition, and communication with the satellite 45.

Figure 6:
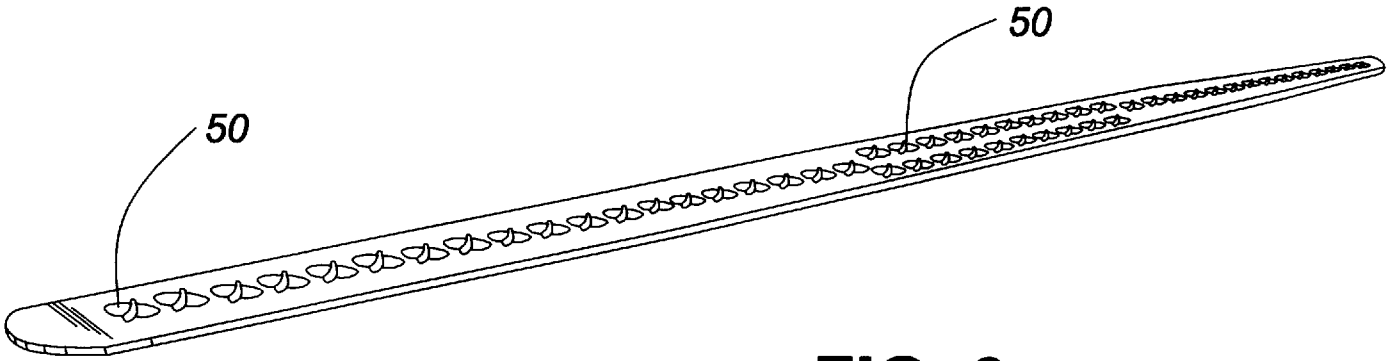
FIG. 6 is a perspective view of an antenna blade array to be used in accordance with the invention.

With respect to the blade arrays themselves, the length of the blade should be much larger than its width. Each array would have a number of circularly polarized volute or turnstile elements 50 arranged in at least one line. Alternatively, the elements can be arranged in rows. If arranged in rows, the number of elements in a row should be at least ten times the number of rows. This will ensure that the scan loss is negligible. For proper coverage and ease of scanning, results have shown that three rows of antenna elements provide acceptable results. Specifically, three rows of 64 elements per row, for a total of 192 elements, is contemplated. As can be seen in FIG. 6, the rows are partly overlapping and staggered arrangement.

Figure 7:
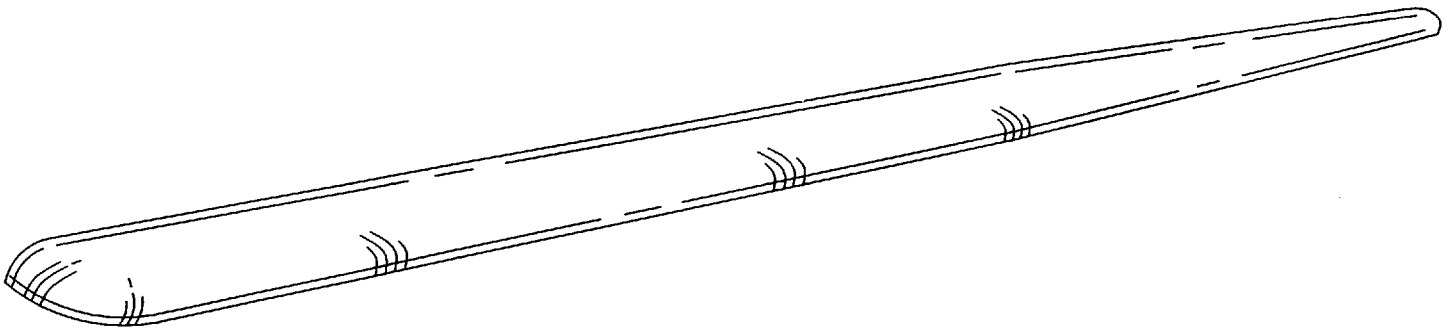
FIG. 7 is a perspective view of an antenna blade array with a radome installed.

FIG. 7 illustrates an antenna array with a radome installed. Such a radome is obviously needed to protect the antenna elements. Also, such a radome would provide reduced drag for the aircraft.

A person understanding this invention may now conceive of alternative structures and embodiments or variations of the above all of which are intended to fall within the scope of the invention as defined in the claims that follow.

I claim:

1. An antenna system comprising:

two linear blade phased array assemblies fixedly mounted on the skin of the upper half of an aircraft fuselage wherein:

the longitudinal axis of each blade array is parallel to the longitudinal axis of said fuselage;

a plane containing the longitudinal axis of the fuselage and the longitudinal axis of a blade array is at an angle with a vertical plane containing the longitudinal axis of the fuselage, said blade arrays being mounted symmetrically on either side of said vertical plane; and each blade array is covered by an aerodynamically shaped radome fixedly mounted on the fuselage.

2. The antenna system as claimed in claim 1 wherein an upper right quarter of the fuselage has an equal number of blade arrays as an upper left quarter of the fuselage.

3. The antenna system as claimed in claim 2 further including a blade array located substantially on the bisecting plane of the fuselage.

4. The antenna system as claimed in claim 2 wherein the symmetry angle between an array plane in the upper right quarter of the fuselage and the bisecting plane is substantially equal to the angle defined by an array plane in the upper left quarter of the fuselage and the bisecting plane.

5. The antenna system as claimed in claim 4 wherein the symmetry angle is 45 degrees.

6. The antenna system as claimed in claim 5 wherein the number of blade arrays is two.

7. The antenna system as claimed in claim 1 further including a plurality of circularly polarized antenna elements arranged in rows on each blade array.

8. The antenna system as claimed in claim 7 wherein on each blade array the number of elements in each row is at least ten times the number of rows on that blade array.

9. The antenna system as claimed in claim 7 wherein each blade array has 192 antenna elements arranged in three rows of 64 elements per row.

10. An antenna array system for communicating between an aircraft and an orbiting satellite comprising a plurality of antenna blade arrays longitudinally mounted in a fixed manner on an upper portion of an airframe such that there is symmetry between a right upper side of the airframe and a left upper side of the airframe.

11. A method of locating blade antenna arrays on an upper portion of an aircraft fuselage, the method comprising:

i) providing a plurality of linear blade phased antenna arrays;

ii) fixedly mounting an equal number of blade arrays on each side of the fuselage;

iii) mounting an aerodynamically shaped radome above each array.

12. The method as claimed in claim 10 wherein step ii) includes the step of symmetrically mounting the blade arrays on each side of a plane that vertically bisects the fuselage.

13. The method as claimed in claim 10 further including the step of locating a blade array on the fuselage such that the blade array is located on a plane that vertically bisects the upper portion of the fuselage.

14. A method of improving the communication between an aircraft and an overhead satellite comprising:

i) providing a plurality of linear blade phased antenna arrays;

ii) symmetrically mounting in a fixed manner an equal number of blade arrays on each side of the aircraft fuselage;

iii) mounting an aerodynamically shaped radome covering each blade array.

* * * * *